US005179803A

United States Patent [19]

Lense

[11] Patent Number: 5,179,803

[45] Date of Patent: Jan. 19, 1993

[54] OPERATING MECHANISM FOR A ROOF WINDOW

[75] Inventor: Robert F. Lense, Rockford, Ill.

[73] Assignee: Amerock Corporation, Rockford, Ill.

[21] Appl. No.: 793,469

[22] Filed: Nov. 18, 1991

[51] Int. Cl.[5] ..... E05F 1/10; E05F 11/00

[52] U.S. Cl. ..... 49/386; 49/324; 74/89.14

[58] Field of Search ..... 49/386, 324, 341, 342, 49/343, 350, 351; 267/175; 74/89.14, 89.15

[56] References Cited

U.S. PATENT DOCUMENTS

| | | | |
|---|---|---|---|
| 2,735,676 | 2/1956 | Lange | 49/386 X |
| 3,085,797 | 4/1963 | Anderberg et al. | 49/324 |
| 3,220,523 | 11/1965 | Hepner | 267/175 X |
| 4,617,758 | 10/1986 | Vetter | 49/324 |
| 5,097,629 | 3/1992 | Guhl et al. | 49/386 |

*Primary Examiner*—Philip C. Kannan
*Attorney, Agent, or Firm*—Leydig, Voit & Mayer

[57] ABSTRACT

The sash of a roof window is swung between closed and open positions in response to the extension and retraction of a pair of pivotally supported crossed arms which are adapted to be swung by an operating mechanism whose mechanical advantage increases as the sash moves from its closed position to its open position. The increasing mechanical advantage of the operating mechanism offsets the decreasing opening force exerted by counterbalance springs during opening of the sash and enables the sash to be opened through its entire range with relatively constant manual effort. The initial preload in the counterbalance springs may be selectively adjusted to compensate for the weight of a particular sash and the pitch of a particular roof.

9 Claims, 3 Drawing Sheets

OPERATING MECHANISM FOR A ROOF WINDOW

BACKGROUND OF THE INVENTION

This invention relates to an operating mechanism for opening and closing a window and particularly a window which is located in the roof of a building.

A roof window typically includes a sash having one end portion pivotally connected to a frame which supports the sash to swing upwardly from a closed position about a generally horizontal axis. Since the sash moves upwardly from its closed position to its open position, significant force is required to open the sash. The force needed to open the sash becomes progressively greater as the sash is raised progressively further from its closed position.

If the roof is relatively shallow, more force is required to open the sash than is the case if the window is located in a steep pitched roof. Also, more force is required to open large and relatively heavy sashes than is needed to open smaller sashes.

To reduce the effort required to open the sash, some sash operators are equipped with counterbalance springs which are loaded by the weight of the sash as the sash is closed. When the sash subsequently is opened, the energy stored in the counterbalance springs is released and reduces the manual effort required to open the sash.

SUMMARY OF THE INVENTION

The primary aim of the present invention is to provide a new and improved roof window operating mechanism whose components are uniquely arranged so as to enable opening of the sash with a relatively constant manual effort throughout the entire range of opening of the sash.

A more detailed object of the invention is to achieve the foregoing through the provision of an operating mechanism having a mechanical advantage which progressively increases as the sash opens wider and as the force applied by the counterbalance springs decreases. In this way, the manual effort required to move the sash from its fully closed position to its fully open position is comparatively constant through the entire range of opening rather than being very low when the sash is first opened and very high as the sash approaches its fully open position.

Still another object is to provide an operating mechanism whose counterbalance springs may be easily adjusted to accommodate the pitch of a particular roof and the weight of a particular sash.

These and other objects and advantages of the invention will become more apparent from the following detailed description when taken in conjunction with the accompanying drawings.

DETAILED DESCRIPTION OF THE PREFERRED EMBODIMENT

Figure 4:
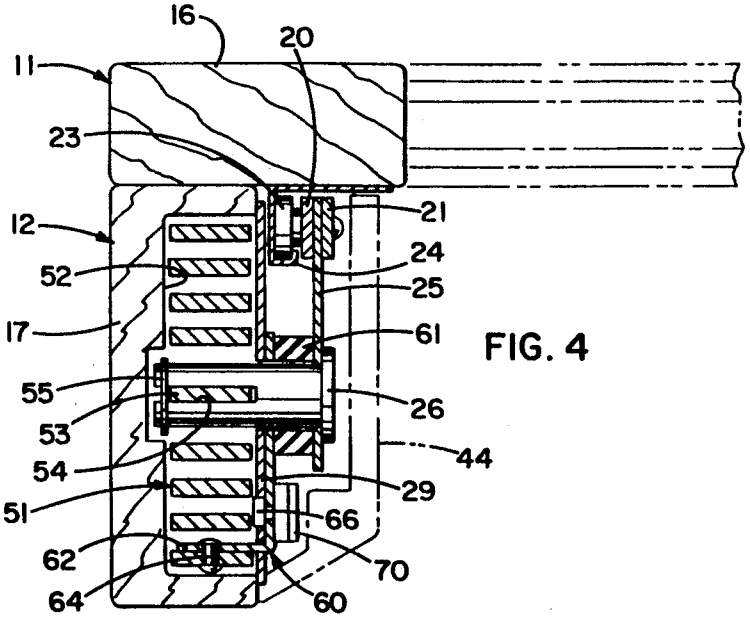
FIGS. 4, 5 and 6 are enlarged cross-sections taken substantially along the lines 4—4, 5—5 and 6—6, respectively, of FIG. 2.
Figure 1:
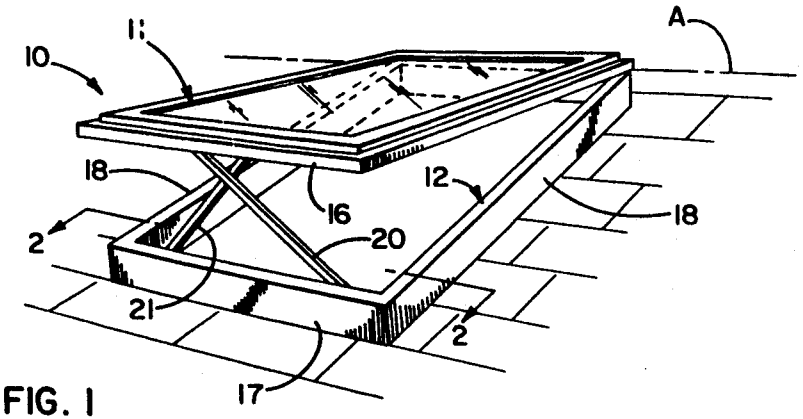
FIG. 1 is a fragmentary perspective view of a roof having a window equipped with a new and improved operating mechanism incorporating the unique features of the present invention, the sash being shown in an open position.

For purposes of illustration, the invention has been shown in the drawings in conjunction with a window 10 having a sash 11 adapted to swing between open and closed positions with respect to a frame 12 which, in this particular instance, is mounted within an opening in a pitched roof 13. Herein, both the sash and the frame are rectangular with the upper end portion of the sash being pivotally connected to the upper end portion of the frame to support the sash for swinging upwardly and downwardly about a laterally extending horizontal axis A. An operating mechanism 15 (FIG. 2) for opening and closing the sash is located adjacent the lower end portions of the sash and the frame. The operating mechanism includes components connected to the lower laterally extending frame member 16 of the sash 11 and includes other components supported on the lower member or "sill" 17 of the frame 12, the sill being located adjacent parallel side members 18 of the frame.

Because the sash 11 is opened in an upward direction, the force required to open the sash becomes progressively greater as the sash moves progressively upwardly from its closed position to its fully open position. In accordance with the present invention, the operating mechanism 15 is constructed such that the manual effort required to actuate the operating mechanism and open the sash is comparatively constant throughout the entire range of opening of the sash.

Figure 7:
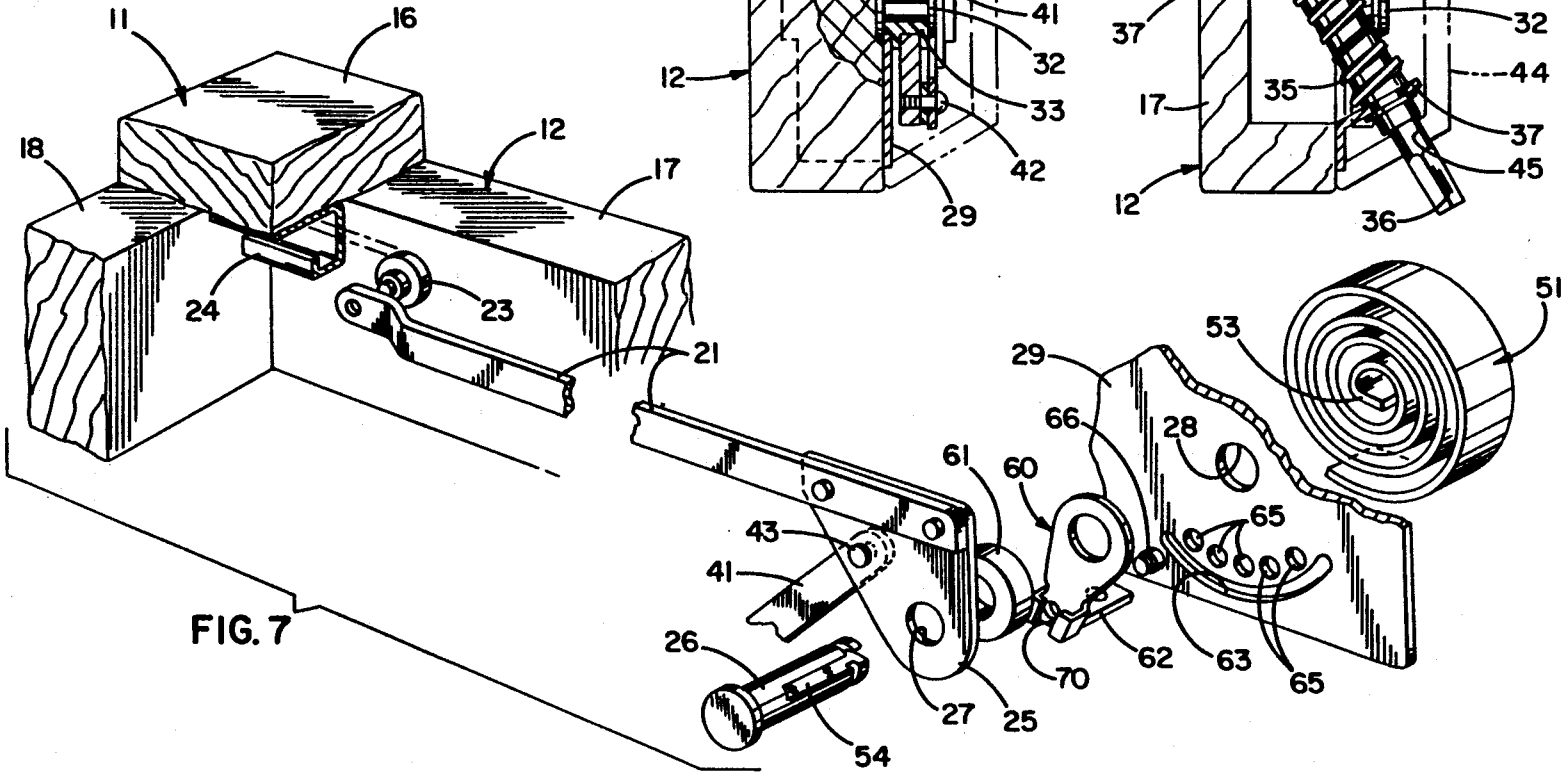
FIG. 7 is an exploded perspective view of certain components of the operating mechanism.

More specifically, the operating mechanism 15 includes a pair of arms 20 and 21 which extend between the sill 17 of the frame 12 and the frame member 16 of the sash 11. The ends of the arms adjacent the frame member 16 carry anti-friction rollers 23 (FIGS. 3 and 7) which are guided within a laterally extending channel 24 secured to the underside of the frame member 16. Thus, the arms are connected to swing with the sash but are capable of traveling laterally along the sash.

The end portions of the arms 20 and 21 adjacent the sill 17 are fixed to plates 25 which are supported to turn about laterally spaced and parallel axes extending perpendicular to the sill 17, the pivot axes herein being defined by a pair of laterally spaced pins 26. Each pin extends through and is fixed securely within a hole 27 (FIG. 7) in the respective plate 25 and also extends through and is rotatably received within a hole 28 in a mounting plate 29. The latter lies in face-to-face relation with the sill 17 and is fastened rigidly to the sill by screws or the like (not shown).

Figure 3:
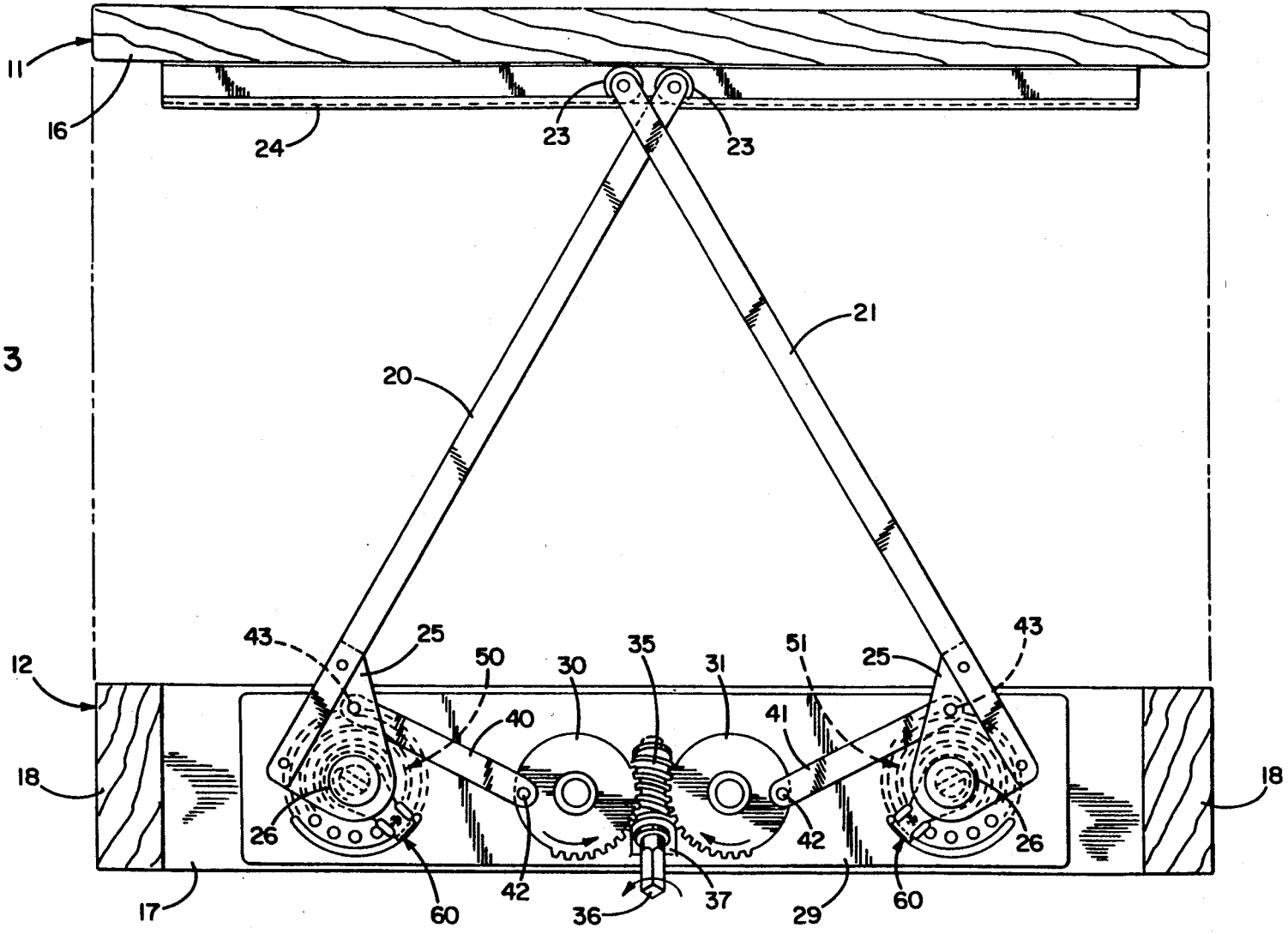
FIG. 3 is a view similar to FIG. 2 but shows the sash in its fully open position.

When the sash 11 is fully open as shown in FIG. 3, the arms 20 and 21 are fully extended and cross one another so that the arms in effect, define an X. The top and bottom of the X are asymmetrical and the rollers 23 are positioned in close proximity to one another near the center of the channel 24 when the sash is fully open. Because the arms are spread widely adjacent the sill 17, the arms hold the sash very stable when the sash is fully open.

As the sash 11 is closed the arm 20 pivots clockwise about the axis of its pin 26 and its roller 23 moves to the right along the channel 24 while the arm 21 pivots counterclockwise and its roller moves to the left along the channel. During closing, the X defined by the crossed arms gradually becomes more symmetrical until the sash 11 reaches a point where the arms are spread wider adjacent the sash than adjacent the sill 17. When the sash is fully closed, the arms are compactly superimposed adjacent the mounting plate 29 with the arm 20 extending laterally toward the pin 26 for the arm 21 and with the arm 21 extending laterally toward the pin for the arm 20.

Figure 5:
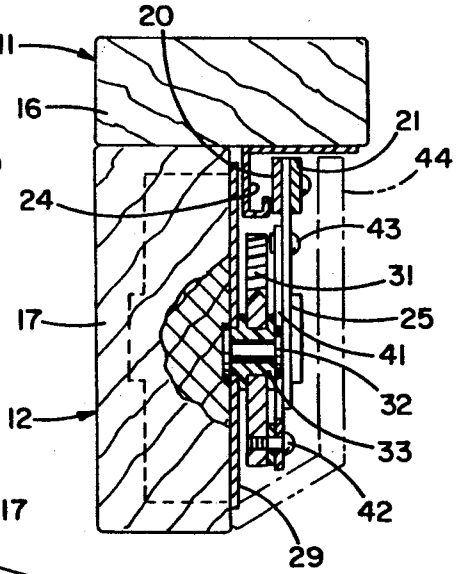

Means are provided for pushing against and extending the arms 20 and 21 in order to open the sash 11 and for pulling on and retracting the arms in order to close the sash. Herein, these means comprise drive members in the form of a pair of laterally spaced worm gears 30 and 31 located between the pins 26 and supported on the mounting plate 29 to turn about axes paralleling those of the pins. Each worm gear is mounted for such turning by a rivet 32 (FIG. 5) extending through a bushing 33 in the gear and secured to the mounting plate 29.

Figure 6:
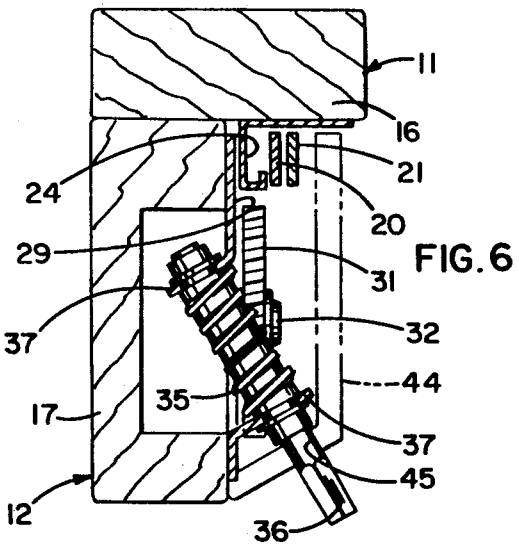

Located between and inclined at about a thirty degree angle relative to the worm gears 30 and 31 is a worm 35 (FIGS. 2 and 6) which is supported to rotate by tab-like brackets 37 struck from the mounting plate 29. One end of the worm is formed with a square driver 36 adapted to mate with a complementary socket (not shown) on one end of a long crank pole (not shown), the socket being temporarily connected to the driver in order to rotate the worm when the crank pole is turned. Rotation of the worm turns the worm gears 30 and 31 simultaneously but in opposite directions. In this particular instance, clockwise rotation of the worm is effective to open the sash 11 while counterclockwise rotation serves to close the sash.

A drive link 40 is connected between the worm gear 30 and the plate 25 of the arm 20 and causes the arm to swing in response to turning of the worm gear. A similar drive link 41 extends between the worm gear 31 and the plate 25 of the arm 21. Each drive link is pivotally connected to its respective worm gear as indicated at 42 and to the plate 25 of its respective arm as indicated at 43. The drive links, the worm gears, the worm 35 and the pins 26 are all enclosed and protected by a plastic cover 44 (FIG. 6) attached to the sill 17 and formed with an opening 45 for receiving the squared end 36 of the worm.

Counterbalance springs 50 and 51 are associated with the arms 20 and 21, respectively. Each spring is received and concealed within a bore 52 (FIG. 4) in the sill 17 and herein is a torsion spring formed by a coil of flat spring wire. The inner end of each spring is formed with a bent tang 53 (FIGS. 4 and 7) received in a slot 54 in the pin 26 and retained axially in the slot by a snap ring 55 (FIG. 4) on the pin. The opposite end of each spring is anchored to the mounting plate 29 in a manner to be described subsequently. When the sash 11 is moved to its closed position, the springs 50 and 51 are wound and loaded by virtue of the arms 20 and 21 turning the pins 26 during swinging of the arms from the extended positions shown in FIG. 3 to the retracted positions shown in FIG. 2. The weight of the downwardly moving sash helps load the springs while the springs enable smooth closing of the sash and guard against the sash banging shut.

When the worm 35 is rotated clockwise to open the sash 11, the oppositely turning Worm gears 30 and 31 act through the drive links 40 and 41 to swing the arms 20 and 21 in opposite directions about the axes of the pins 26 and thereby move the arms toward their extended positions. At the same time, the springs 50 and 51 begin unwinding and exert torque on the pins to assist in extending the arms and to reduce the manual torque required to rotate the worm 35.

Figure 2:
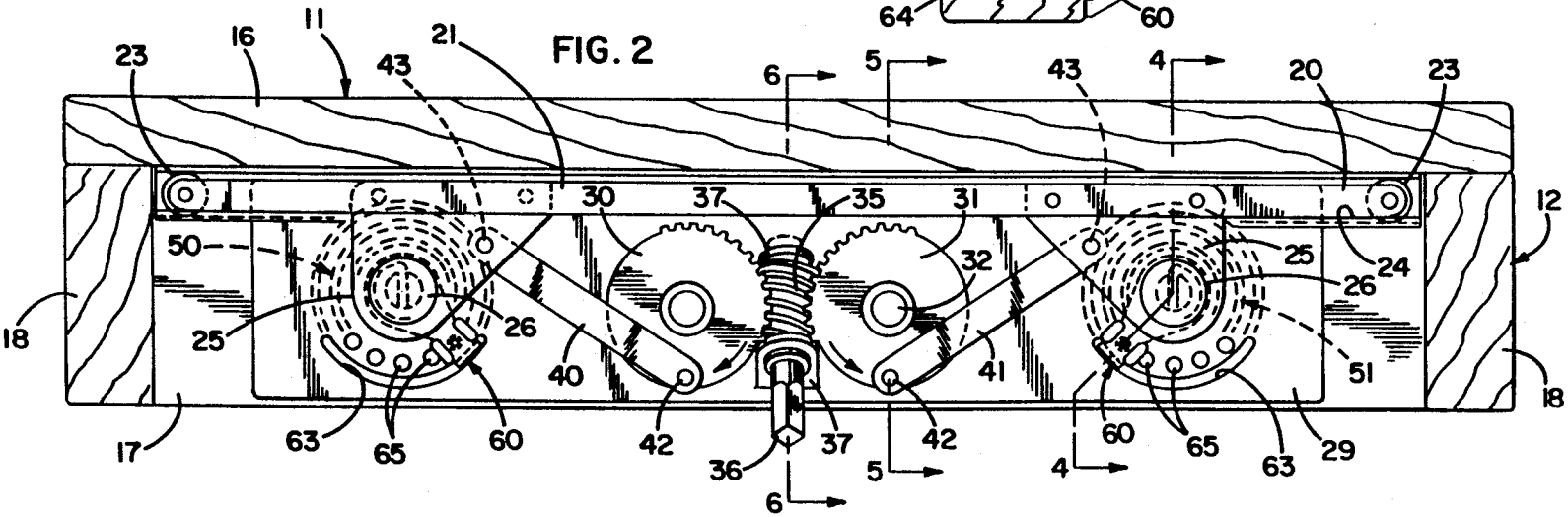
FIG. 2 is an enlarged fragmentary cross-section taken substantially along the line 2—2 of FIG. 1 but with the sash in its closed position.

When the sash 11 is fully closed as shown in FIG. 2, the springs 50 and 51 are fully wound and exert maximum torque on the arms 20 and 21. The pivots 42 for the drive links 40 and 41, however, are located at bottom dead center with respect to the worm gears 30 and 31. Accordingly, as the sash first opens, the horizontal force component exerted on the arms 20 and 21 by the drive links 40 and 41 is substantially greater than the vertical component and thus a relatively high percentage of the total force required to open the sash is supplied by the springs rather than through the drive links. As the sash is opened further, the opening force furnished by the springs decreases as the springs unwind. The mechanical advantage of the operating mechanism 15 increases, however, as the pivots 42 for the drive links 40 and 41 move away from bottom dead center with respect to the worm gears 30 and 31 and cause the vertical force component exerted by the drive links on the arms to increase. As a result, the sash may be opened throughout its entire range by applying relatively constant torque to the worm 35 and exerting relatively constant manual effort rather than the manual effort fluctuating from a very low magnitude when the sash first begins to open to a very high magnitude when the sash approaches its fully open position. This is not to say that the sash can be opened throughout its entire range with constant torque applied to the worm but the torque variations of the present operating mechanism 15 are far less pronounced than is the case with previous operating mechanisms of the same general type.

A sash 11 installed on a shallow roof does, of course, require more opening force than one used on a steep pitched roof. Also, greater opening force is required for heavier sashes. Advantageously, means are provided for adjusting the springs 50 and 51 so that the springs may exert more opening force on a heavier sash or a sash on a shallow roof. If the sash is comparatively light or is installed on a steep roof, the opening force applied by the springs may be reduced so as to enable easier winding of the springs when the sash is closed and thereby reduce the effort needed to close the sash.

Herein, the adjusting means for each of the springs 50 and 51 comprises a lever 60 (FIGS. 4 and 7) rotatably supported on the pin 26 and separated from the pivot plate 25 by a washer-like spacer 61 made of rubber or other compressible material. A finger 62 integral with one end of the lever projects through an arcuate slot 63 (FIG. 7) in the mounting plate 29 and is connected to the outer end portion of the spring by a rivet 64 (FIG. 4). The slot 63 is curved about the axis of the pin 26. Located above and concentric with the slot is an arcuate row of angularly spaced detent openings 65 (FIG. 7) formed through the mounting plate 29. The openings 65 are adapted to selectively receive a pin-like detent 66 attached to the lever 60 just above the finger 62. The detent 66 normally is located in one of the openings 65 and holds the outer end of the spring 50, 51 in fixed angular relation with the inner tang 53 of the spring when the sash 11 is closed so as to maintain a predetermined preload in the spring.

By inserting a tool (not shown) in the form of a rectangular bar into a channel 70 (FIG. 7) in the lever 60, the latter may be slid axially along the pin 26 as permitted by the compressible spacer 61 in order to withdraw the detent 66 from the opening 65. The lever then may be turned on the pin by the tool to bring the detent into registry with another opening 65, the detent being pushed into that opening by the spacer 61 when pressure on the tool is released. In this way, the initial preload load on the springs may be selectively adjusted to enable turning of the springs in accordance with the weight of the sash 11 and the pitch of the roof 13.

I claim:

1. A window having a frame, a sash having first and second opposite end portions, means pivotally connecting said first end portion of said sash to said frame and supporting said sash to swing between open and closed positions about a laterally extending axis, and mechanism on said frame adjacent the second end portion of said sash for moving said sash between said positions, said mechanism comprising first and second arms each having one end portion connected to the second end portion of the sash to swing with and to move laterally along the sash, said first and second arms having opposite end portions supported on said frame to turn about first and second laterally spaced axes, respectively, selectively operable means located between said first and second axes for swinging said first and second arms simultaneously but oppositely about said first and second axes, respectively, in either an opening direction or a closing direction, said arms extending and pushing said sash to said open position when said arms are swung in said opening direction, said arms retracting and pulling said sash to said closed position when said arms are swung in said closing direction, and first and second torsion springs coaxial with said first and second axes and connected between said frame and said first and second arms, respectively, said springs being wound as said arms are swung in said closing direction and then unwinding as said arms are swung in said opening direction thereby to assist in moving said sash to said open position.

2. A window as defined in claim 1 in which said selectively operable means comprise first and second worm gears supported on said frame to turn about axes paralleling said first and second axes, a worm located between and operable to simultaneously turn said worm gears, a first drive link having one end pivotally connected to said first worm gear and an opposite end connected to said first arm, and a second drive link having one end pivotally connected to said second worm gear and an opposite end pivotally connected to said second arm.

3. A window as defined in claim 2 in which said one end of each drive link is located at bottom dead center with respect to the respective worm gear when said sash is in said closed position.

4. A window having a frame, a sash having first and second opposite end portions, means pivotally connecting said first end portion of said sash to said frame and supporting said sash to swing between open and closed positions about a laterally extending axis, and mechanism on said frame adjacent the second end portion of said sash for moving said sash between said positions, said mechanism comprising first and second arms each having one end portion connected to the second end portion of the sash to swing with and to move laterally along the sash, said first and second arms having opposite end portions supported on said frame to turn about first and second laterally spaced axes, respectively, first and second laterally spaced drive members supported on said frame between said first and second axes to turn about axes paralleling said first and second axes, a first drive link pivotally connected to said first drive member and to said opposite end portion of said first arm, a second drive link pivotally connected to said second drive member and to said opposite end portion of said second arm, selectively operable means for turning said drive members simultaneously but oppositely in either an opening direction or a closing direction, said first and second drive members acting through said first and second links to push on said first and second arms and swing said arms in opposite directions about said first and second axes, respectively, when said drive members are turned in said opening direction whereby said arms extend and push said sash to said open position, said first and second drive members acting through said links to pull on said first and second arms and swing said arms reversely about said first and second axes, respectively, when said drive members are turned in said closing direction whereby said arms retract and pull said sash to said closed position, and first and second torsion springs coaxial with said first and second axes and connected to said first and second arms, respectively, said springs being wound as said arms retract and then unwinding as said arms extend thereby to assist in moving said sash to said open position.

5. A window as defined in claim 4 in which said arms cross one another and define an X when said sash is in said open position, said arms being superimposed with said first arm extending toward said second axis and with said second arm extending toward said first axis when said sash is in said closed position.

6. A window as defined in claim 4 in which said drive members comprise worm gears, said selectively operable means comprising a worm located between said worm gears and operable to rotate said worm gears in opposite directions when said worm is turned in one direction.

7. A window as defined in claim 4 further including selectively adjustable means associated with each spring for selectively changing the torque exerted by the spring when said sash is in said closed position.

8. A window as defined in claim 7 in which each spring comprises a length of flat wire wound in a coil, each spring having a first end connected to the respective arm and having a second end connected to said selectively adjustable means, said selectively adjustable means including means enabling said second end of each spring to be anchored to said frame at selected angular positions relative to the first end of the spring when said sash is in said closed position.

9. A window as defined in claim 8 in which the selectively adjustable means for each spring comprises a detent connected to the second end of the spring and further comprises a plate connected to said frame and having a plurality of angularly spaced openings for selectively receiving and holding said detent.

* * * * *